United States Patent [19]

Reiss

[11] Patent Number: 4,712,796

[45] Date of Patent: Dec. 15, 1987

[54] DEVICE FOR OBTAINING SUBSETS FROM A FIELD OF CHARACTERS

[75] Inventor: Alan Reiss, Rexford, N.Y.

[73] Assignee: World Gaming Consultants, Hingham, Mass.

[21] Appl. No.: 830,455

[22] Filed: Feb. 18, 1986

[51] Int. Cl.[4] ..... A63B 71/06

[52] U.S. Cl. ..... 273/148 R

[58] Field of Search ..... 273/148 R

[56] References Cited

FOREIGN PATENT DOCUMENTS 567307 9/1975 Switzerland ..... 273/148 R

*Primary Examiner*—Anton O. Oechsle

*Attorney, Agent, or Firm*—Schmeiser, Morelle & Watts

[57] ABSTRACT

A device for generating a plurality of subsets from a prechosen field, having two discs held in registry to each other and secured for rotatable movement through a plurality of steps. One of the discs is clear and has a designated area for recording a field of characters, usually numerals. The second surface aligned beneath the first surface has a plurality of segments, each of which corresponds to the designated area as the wheels are being rotated with respect to one another. The segments on the second surface have portions which are darkened for blocking out certain characters within the designated area and other portions of the segments are light for illuminating portions of the designated area and the characters placed within those portions. Rotation of the two discs so that each segment corresponds to the designated area yields a plurality of subsets from the field of characters inserted within the designated area.

1 Claim, 1 Drawing Figure

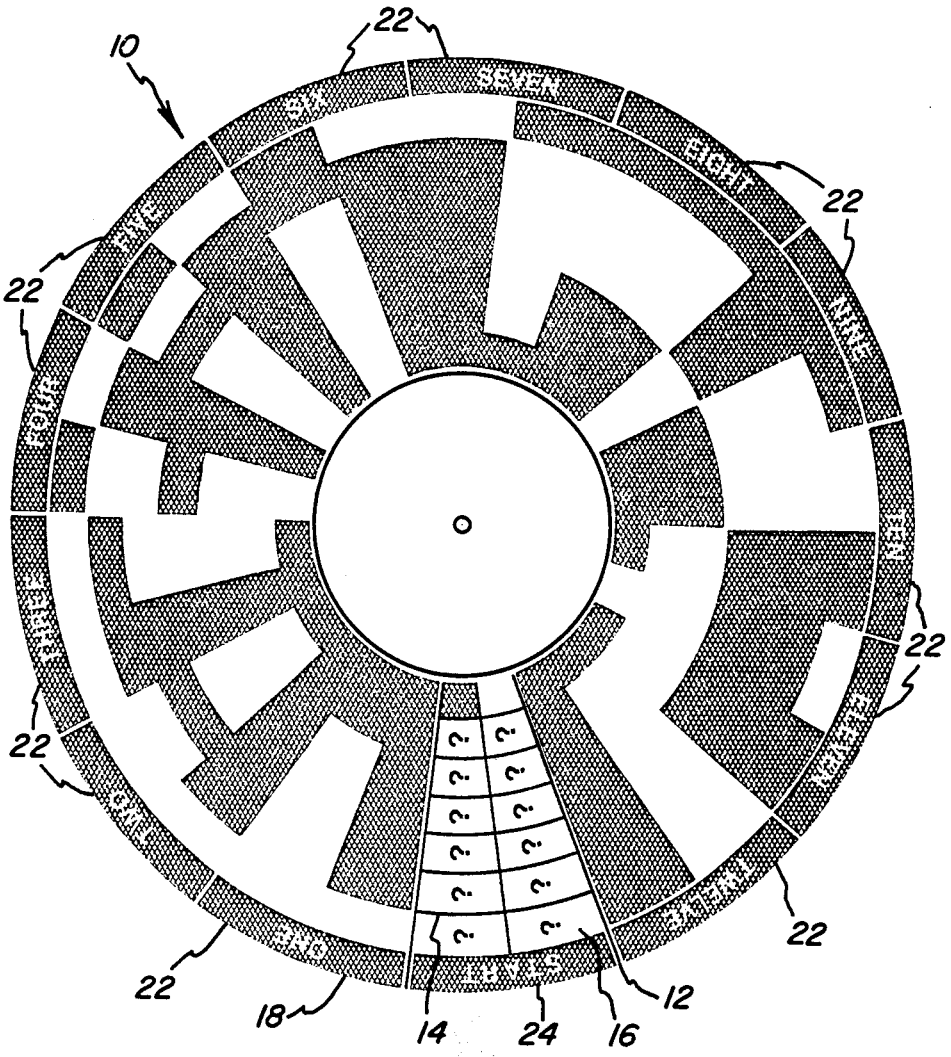
10
22
SEVEN
SIX
EIGHT
FIVE
NINE
FOUR
TEN
THREE
ELEVEN
TWO
TWELVE
ONE
START
12
14
16
18
24

DEVICE FOR OBTAINING SUBSETS FROM A FIELD OF CHARACTERS

FIELD OF THE INVENTION

Generally this invention relates to a device for generating numbers. More specifically, this device provides the user with a group of independent subsets from a field of preselected characters.

BACKGROUND OF THE INVENTION

As is well known to those familiar with wagering on lottery drawings, there are various mathematical systems to increase one's prospect of obtaining a winning combination. For example, Ivan Dimitrov's book "HOW TO WIN AT LOTTO AND PICK 6" presents a variety of numerical indexes which enable the player to spread the bets placed so as to produce a greater opportunity to obtain a winning combination, the object being to spread your bets so as to avoid redundant combinations.

For example, if one were to choose a field of numbers consisting of thirteen separate numerical values, the player would then place bets on a variety of subsets with each subset containing six numerals. Using the Dimitrov system, the indexes would guide the player to the numerals in each subset such that for the fewest number of bets (or subsets) the player would be guaranteed that if the numbers randomly chosen fell within his field, he would have at least one subset containing four numbers that were randomly chosen.

Thus, the player improves the odds of hitting these smaller number combinations than would normally be obtainable from random selection. Of course such a system does not increase the odds of choosing an exact six number match.

In order to accomplish this and other similiar mathematical applications, the player is guided through indexes which are both confusing and time consuming. For example, in Dimitrov's system the player chooses a field of numbers and then applies a numerical designation starting with the number one to each number in the field. For example, if the field had thirteen numbers, the player would assign a numerical designator from 1–13 to each number in the field. The individual then moves to the indexes which apply to fields having thirteen numbers. Each index contains six numerical designators, from one to thirteen. The player translates each designator in each index into the corresponding numeral in his field to derive a series of numerical subsets.

Important disadvantages of such a procedure involve the likelihood of errors and, more importantly, the consumption of time which is often so great that the player is discouraged before starting and therefore resorts to random selection.

Another important disadvantage results from the fact that a large number of indexes are required in order to apply such a system. This difficulty is compounded when one considers that there are a large variety of lottery games not only from state to state, but even within each state. Thus, the player must literally have a book of indexes available when making his choices.

It is therefore an object of this invention to provide a new and improved device for obtaining subsets from a field of characters which applies mathematical principles and is easy to use.

Another object of this invention is to provide a new and improved device for obtaining numerical subsets which is compact and easy to carry.

Another object of this invention is to provide a new and improved device for obtaining subsets from a field of characters which can be used over and over again for placing different bets and where the player can easily change the field of characters from which the subsets are being chosen.

Objects and advantages of the invention are set forth in part herein and will also become obvious to those who either study this disclosure or use the subject invention, the same being realized by means of the instrumentalities and combinations pointed out in the appended claims. The invention consists in the novel parts, constructions, arrangements, combinations and improvements herein shown and described.

SUMMARY OF THE INVENTION

It has been found that the objects of this invention may be realized by operating two circular plates in registry with each other so as to overlap and secured to each other such that each plate is rotatable with regard to the other plate. One of the plates is transparent and has a designated area consisting of a number of defined spaces. The second plate is divided into a plurality of segments, each segment being of a similar size and arranged so as to overlay the designated area at some point during the rotation of the plates. One of the segments in the second plate is clear such that when that segment is aligned with the designated area, all of the spaces and anything written in the spaces are clearly visible. The remaining segments have portions which are darkened so as to block out predetermined parts of the designated area so that only some of the spaces and the designators therein are visible. The designators contained within the visible spaces comprise a subset of the overall field of characters which were originally placed within the designated area. By rotating the plates so that each segment overlies the designated area, one may obtain a variety of subsets which may reflect previously calculated mathematical approaches to choosing the most advantageous subsets.

This invention provides a remarkably easy and efficient way to obtain subsets from a predetermined field of characters. Since the top plate is transparent, the user may fill in the spaces with any one of a number of presently available markers. Should the user at any time wish to change the field, he need only to erase the characters within the spaces and insert a new field of characters. Thus, one simply rotates the plates through each segment and copies onto an appropriate bet slip the characters, usually numbers, which remain visible.

The accompanying drawings, referred to herein and constituting a part hereof, illustrate the preferred embodiment of the invention and together with the description, serve to explain the principles of the invention.

BRIEF DESCRIPTION OF THE DRAWINGS

FIG. 1 is a top view of the invention disclosing the preferred embodiment of the invention for one type of lottery system.

DESCRIPTION OF THE PREFERRED EMBODIMENT

Referring more particularly to FIG. 1, there is illustrated a subset generating device 10 of this invention.

A first surface 12 is a transparent circular plate having a designated area 14 that is divided into a plurality of spaces 16. The spaces may be filled with any characters such as numerical designations and together create a prechosen field. Beneath the first surface 12 is a second surface 18 which is also a circular plate. The two plates are aligned over one another and rotatably secured to each other by means of a centrally located pin 20. Pin 20 holds the two plates in registry with each other.

The second surface is divided into a plurality of segments 22. FIG. 1 shows thirteen segments, however, it will be appreciated that the number of segments may be varied depending upon the type of lottery game being played.

The segment 24 marked "Start" provides a white background for each of the characters in spaces 16 when the Start" segment 24 is aligned beneath the designated area 14.

The remaining segments "one" through "twelve" have portions which are darkened and portions which are light. When the designated area 14 is moved over each of the segments, the darkened portions obscure the characters in the spaces to which they correspond and the light portions illuminate their corresponding spaces and characters. Thus, various subsets of the initial field of characters may be obtained. The arrangement of darkened and light portions are such that numerical sub-combinations reflecting a predetermined mathematical approach are obtained. As shown in FIG. 1, subsets of six numerals are obtained as the designated area is moved over and corresponds with each of the segments 22.

In operation, the player fills in the spaces 16 with a plurality of characters, for explanation purposes, these characters will be considered to be numerical. These numerical characters create a prechosen field. The user than rotates the plates with respect to one another so that the designated area 14 overlies each of the segments 22. The user stops at each segment and transfers the illuminated numbers to a betting slip. Thus, without comparison or complicated calculations, the player may spread his bets among the numerical field in the most beneficial manner so as to increase his odds of hitting at least a small number combination.

Should the user wish to alter his numerical field, the characters may be simply removed if applied to the plastic transparent first surface with an eraseable implement such as a grease pen. The new numerals or other characters may then be inserted in order to create a new field from which the subsets may be chosen.

It should be appreciated that by altering the number of segments as well as the numerical field, one can easily adapt the subject invention to be compatible to virtually all lottery games. For these and other reasons, this invention in its broader aspects is not limited to the specific embodiments herein shown and described but departures may be made therefrom within the scope of the accompanying claims, without departing from the principles of the invention and without sacrificing its chief advantages.

What is claimed is:

1. A device for generating a plurality of subsets from a prechosen field of characters comprising:

a first circular, substantially transparent surface having a designated area for recording a field of characters, said designated area having a plurality of spaces aligned in at least two adjacent rows extending outwardly toward the perimeter of the device, said spaces closer to the periphery being larger than those spaces further from the periphery;

a second circular surface lying beneath and in registry with respect to said first surface, said surfaces being rotatable with regard to each other, said second surface having a plurality of marked segments each of which is adapted to correspond to the designated area of the first surface as the surfaces are moved, one of said segments rendering visible all the characters in the designated area, the other segments having portions which correspond to respectively different arrays of spaces of the designated area and obscure some of the characters while allowing the characters in the spaces which do not correspond to the obscuring portions to remain visible, said designated area and segments corresponding to each other such that aligning the designated area over each segment provides a visible array of distinct subsets of equal size.

* * * * *